United States Patent [19]

Masaru

[11] Patent Number: 4,687,011

[45] Date of Patent: Aug. 18, 1987

[54] ROTARY CLEANING DEVICE FOR DRAIN PIPE AND THE LIKE

[76] Inventor: Uraki Masaru, 2-52-703, 4 Chome, Shiohama, Ichikawa-shi, Chiba-ken, Japan

[21] Appl. No.: 782,944

[22] Filed: Sep. 24, 1985

[30] Foreign Application Priority Data

Sep. 28, 1984 [JP] Japan ..... 59-203829

[51] Int. Cl.[4] ..... B08B 9/04

[52] U.S. Cl. ..... 134/167 C

[58] Field of Search ..... 134/167 C, 168 C; 4/256; 15/104.12, 104.1 R; 239/DIG. 13, 227; 202/241

[56] References Cited

U.S. PATENT DOCUMENTS

| | | | |
|---|---|---|---|
| 634,270 | 10/1899 | Patton | 15/104.12 |
| 2,089,597 | 8/1937 | Carter | 15/104.12 X |
| 2,178,801 | 11/1939 | Mattern et al. | 15/104.12 |
| 2,201,733 | 5/1940 | Kollmann | 15/104.1 R X |
| 3,195,548 | 7/1965 | Lestakis | 134/167 C |
| 3,440,096 | 4/1969 | Scott | 202/241 X |

FOREIGN PATENT DOCUMENTS

| | | | |
|---|---|---|---|
| 49-37403 | 10/1974 | Japan . | |
| 54-110658 | 8/1979 | Japan . | |
| 55-20380 | 2/1980 | Japan . | |
| 784585 | 10/1957 | United Kingdom | 134/167 C |

*Primary Examiner*—Philip R. Coe

*Attorney, Agent, or Firm*—Wenderoth, Lind & Ponack

[57] ABSTRACT

A rotary cleaning device for drain pipes and the like wherein a universal guide is connected to a nozzle provided at a tip of a high-pressure hose, and the tip of the high-pressure hose is drawn out into the pipe and high-pressure water from the nozzle is jetted radiantly in a slant rearward direction of the nozzle, and the tip of the high-pressure hose is arranged to advance along the pipe sequentially while the high-pressure hose is rotated, whereby the direction of the nozzle is changed according to the rotation of the high-pressure hose, and the nozzle is rotated spirally along the inner wall of the pipe by the change.

4 Claims, 10 Drawing Figures

ROTARY CLEANING DEVICE FOR DRAIN PIPE AND THE LIKE

BACKGROUND OF THE INVENTION

The head of a tip of a conventional high-pressure hose is composed of a nozzle formed with a plurality of jet holes for jetting high pressure water aslantly in the rearward direction radiantly, and a universal guide connected to the tip of the nozzle.

The foregoing high-pressure hose, as disclosed in the Japanese utility model publications No. 55-20380 and No. 49-37402, is housed in a rotary drum, and the high-pressure hose is rotated by the revolution of the rotary drum. The nozzle of the tip of the high pressure hose, as disclosed in the Japanese patent laid open publication No. 54-110658, advances while revolving inside of a drain pipe by a propulsion force by the high pressure water jetted from the nozzle and a draw-out operation of the high pressure hose from the rotary drum to clean the inside of the drain pipe.

When a high-pressure hose is rotated in the vertical pipe and the nozzle connected to the high-pressure hose is rotated in the vertical pipe, the nozzle revolves along the inner wall of the pipe. In this condition, when the high-pressure hose is fed into the pipe by being drawn out gradually from the rotary drum, the nozzle spirally revolves along the inner wall of the pipe. When the drain pipe is a horizontal pipe, even if the high-pressure hose is fed while rotating in the pipe, the nozzle advances straight forward and does not rotate spirally along the wall of the pipe. The high pressure water jet pressure of the nozzle is lowered when it is separated from the wall of the pipe so that in order to break the solid which is adhered and hardened on the upper portion of the pipe, much higher pressure and much more water are required, and thus, the inside of the pipe cannot be cleaned uniformly at high efficiency.

SUMMARY OF THE INVENTION

This invention relates to rotary cleaning devices for drain pipe and the like which are used for cleaning the drain pipe and the like of the piping installations in high-rise buildings.

In the device for cleaning the inside of the pipe by high-pressure water that jets from a nozzle provided at a tip of a high pressure hose connected to a high-pressure water feeding device, a universal guide is connected to the tip of the nozzle and the high-pressure water is jetted aslant in a rearward direction of the nozzle radiantly, and the propulsion force is generated in the nozzle by the jet force, and the hose is fed into the pipe while rotating the high-pressure hose, and the inside of the pipe is cleaned by the high-pressure water jetted from the nozzle. In the improved device the direction of the propulsion force of the nozzle is arranged to change according to the rotation of the high-pressure hose, and the nozzle is arranged to revolve spirally in the pipe along the inner wall of the pipe. In this construction, the solid adhered material on the inner wall of the pipe can be pulverized by the high-pressure portion of the jet water jetted from the nozzle, eliminating the loss of quantity of a water and cleaning the inside of the vertical pipe and the lateral pipe at high efficiency.

DESCRIPTION OF THE PREFERRED EMBODIMENT

The construction of this invention will be described in the following by referring to the attached drawings.

Figure 1:
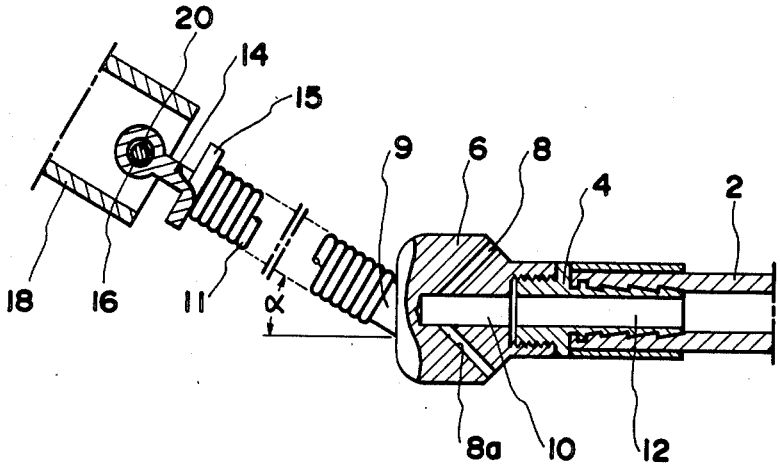
FIG. 1 is a cross section showing an embodiment of this invention.
Figure 2:
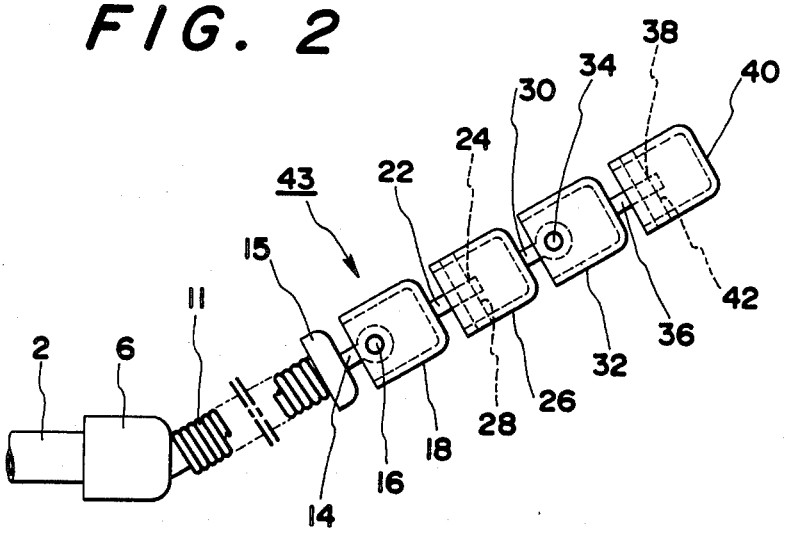
FIG. 2 is a side view.
Figure 3:
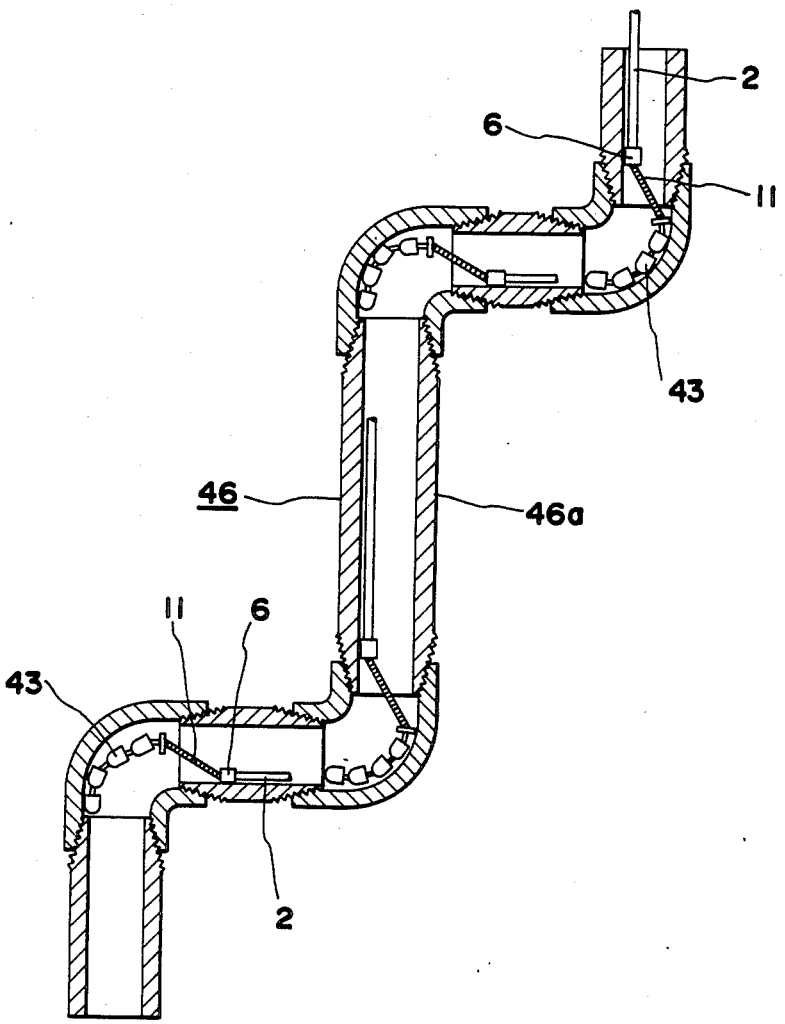
FIG. 3 is an explanatory vertical cross section of a pipe system.
Figure 4:
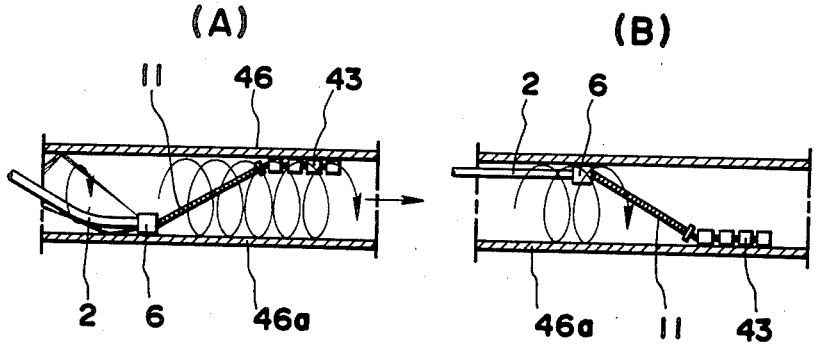
FIGS. 4A and 4B are explanatory cross sections of parts of a pipe.
Figure 5:
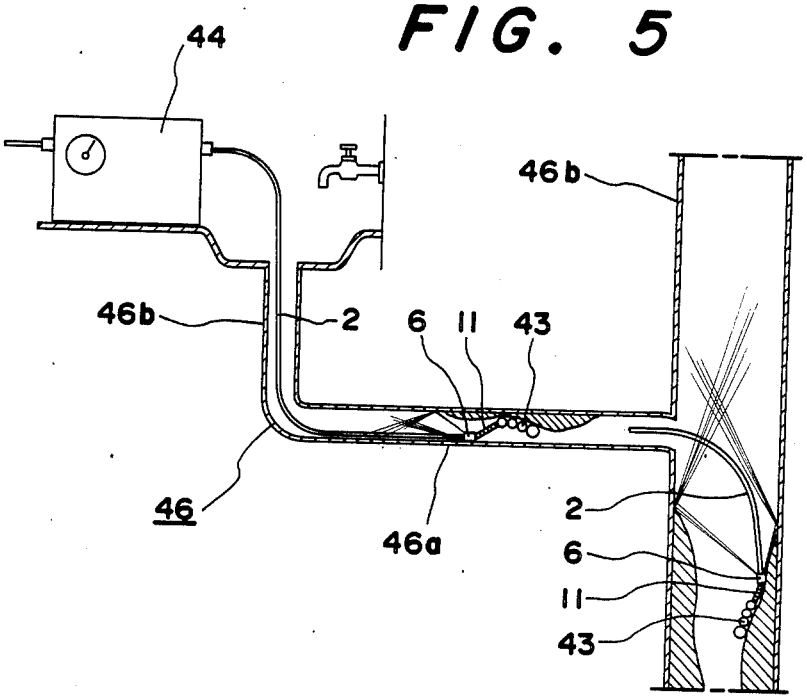
FIG. 5 is an explanatory vertical cross section of a pipe system.

In FIG. 1, reference numeral 2 denotes a high-pressure hose, and one end of the hose is connected to a nozzle 6 by means of a hose joint 4. Jet holes 8; 8*a* that are bored at equal intervals around the nozzle 6 are communicated with the inside of the hose 2 by means of an axial hole 10 of the nozzle 6 and an axial hole 12 of the hose joint 4. The high pressure water is jetted aslant in a rearward direction of the nozzle 6 from the jet holes 8, 8*a*, and the propulsion force in a direction parallel to a center axial line thereof is generated in the nozzle 6 by the high-pressure water. Namely, the jet holes 8, 8*a* are disposed conically, and thus, the propulsion force is generated in the direction parallel to the center axial line of the conical shape. A projecting shaft 9 is provided at the tip of the nozzle 6 which inclines at a predetermined angle $\alpha$ relative to the center axial line of the nozzle 6, for example, inclines 30 degrees. Reference numeral 11 denotes a snake wire formed by winding a resilient wire in coil form, and its one end is fitted and fixed to the projecting shaft 9. The other end of the snake wire 11 is fitted and fixed to a projecting shaft (not shown) provided on a board 15. The snake wire 11 inclines at a predetermined angle $\alpha$ relative to the center axial line of the nozzle 6. A hole 16 is perforated at the tip of a connecting lever 14 projected on the other surface of the board 15. Reference numeral 18 denotes a guide made of a cylindrical metal member, and a shaft 20 is mounted in the vicinity of an end of an opening in a right angle direction relative to the center axial line of the guide 18, and the shaft 20 is loosely fitted in the hole 16. A connecting lever 22 projects from a center portion of a bottom portion of the guide 18, and a hole 24 is formed at the tip of the connecting lever 22 in a direction offset by 90 degrees relative to the direction of the hole 16. Reference numeral 26 denotes a guide made of a cylindrical metal member, and a shaft 28 is mounted in the vicinity of an end of an opening thereof, in a direction perpendicular to the center axial line of the guide 26, and the shaft 28 is loosely fitted to the hole 24. A connecting lever 30 projects from a center portion of a bottom portion of the guide 26, and a hole is formed on the tip of the connecting lever 30 in the direction having an angle of 90 degrees relative to the direction of the hole 24. Reference numeral 32 denotes a guide made of a cylindrical metal member, and a shaft 34 is mounted in the vicinity of an end of an opening thereof in the direction perpendicular to the center axial line of the guide 32, and the shaft 34 is loosely fitted to the hole of the connecting lever 30. A connecting lever 36 projects from the center portion of the bottom portion of the guide 32, and a hole 38 is formed at the tip of the connecting lever 36 projecting from the other surface of the board 15 in the direction having an angle of 90 degrees relative to the direction of the hole of the connecting lever 30. Reference numeral 40 denotes a tip guide made of a cylindrical metal member, and a shaft 42 is mounted in the vicinity of an end of an opening thereof in the direction perpendicular to the center axial line of the guide 40, and the shaft 42 is loosely fitted to the hole 38 of the connecting lever 36. Each guide 18, 26, 32, 40 is rotatable in a range of almost 40 degrees centering around the shafts 20, 28, 34, 42 relative to the connecting shafts 14, 22, 30, 36 connected to the guides. The guides 18, 26, 32, 40 form a universal guide 43. The shafts 20, 28, 34, 42 of each guide 18, 26, 32, 40 are mutually offset by 90 degrees, but they may be set in the same direction. The high-pressure hose 2 is connected to a drain outlet of the pump by means of a terminal machine 44 as shown in FIG. 5. The terminal machine 44 is constructed in such way that the drum for housing the high-pressure hose 2 in coiled condition is rotatably disposed, and when the drum is rotated manually or by a motor, the high-pressure hose 2 is arranged to rotate. The construction of this terminal machine 44 is disclosed in detail in Japanese Utility model publication No. 56-36856. By the way, reference numeral 46 denotes a drain pipe.

The operation of the embodiment of this invention will be described in the following.

The cleaning of the drain pipe 46 is carried out by jetting the high-pressure water pressurized by the pump through the jet holes **8, 8*a* of the nozzle 6 mounted at the tip of the hose 2. The material adhered to the inside of the pipe is pulverized and removed by the high-pressure water jetted from the nozzle 6 in the aslant rearward direction of the nozzle 6, and at the same time, the nozzle 6 advances in the pipe by the propulsion force of the high-pressure water jetted from the nozzle 6 and the drawing-out of the high-pressure hose 2 by the manual or an automatic operation. In the lateral pipe 46*a*, as shown in FIG. 5, when the high-pressure hose 2 is rotated in the pipe, the snake wire 11 abuts the inner wall of the pipe by the rotation of the hose 2, and the direction of the nozzle 6 is changed, and as a result, the direction of the propulsion force by the high-pressure jet force of the nozzle 6 is tilted relative to the lateral cross section of the pipe 46*a*, and the nozzle 6 is revolved spirally along the inner peripheral wall of the pipe by the change of direction of the propulsion force. In the vertical pipe 46*b*, the high-pressure hose 2 is rotated at a constant speed, and the nozzle 6 is revolved spirally in the inner wall of the pipe by the drawing-out of the high-pressure hose 2, and the jet water jetted through a plurality of jet holes 8, 8*a* of the nozzle 6** cleans the inner wall of the pipe evenly with efficiency.

Figure 6:
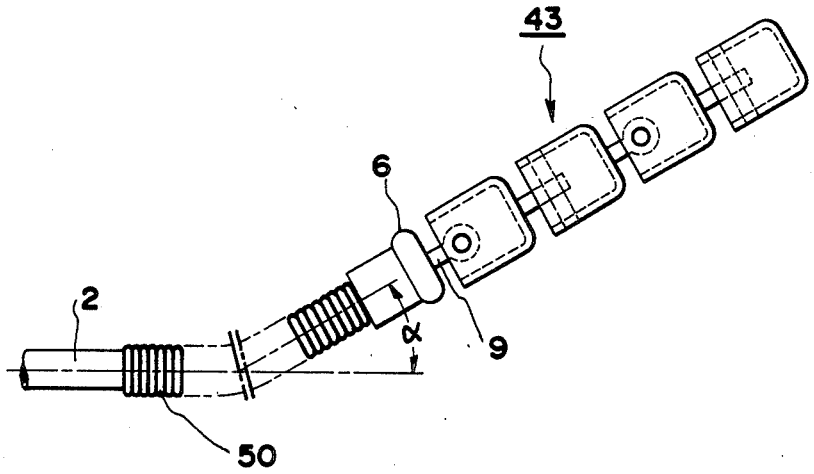
FIG. 6 is a side view showing another embodiment.
Figure 7:
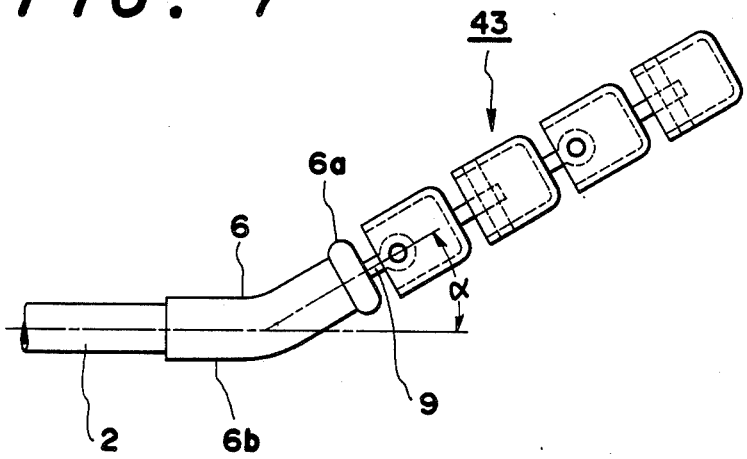
FIG. 7 is a side view showing another embodiment.
Figure 8:
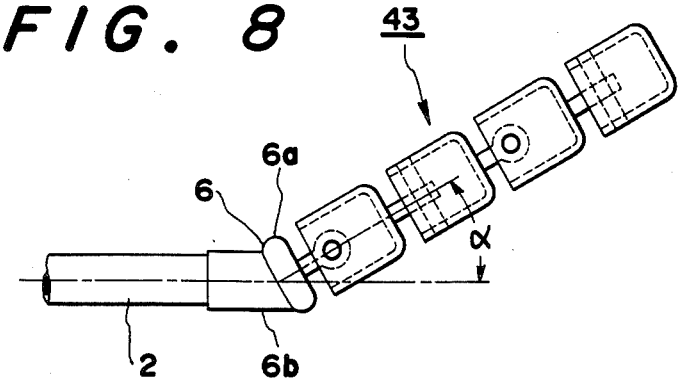
FIG. 8 is a side view showing another embodiment.
Figure 9:
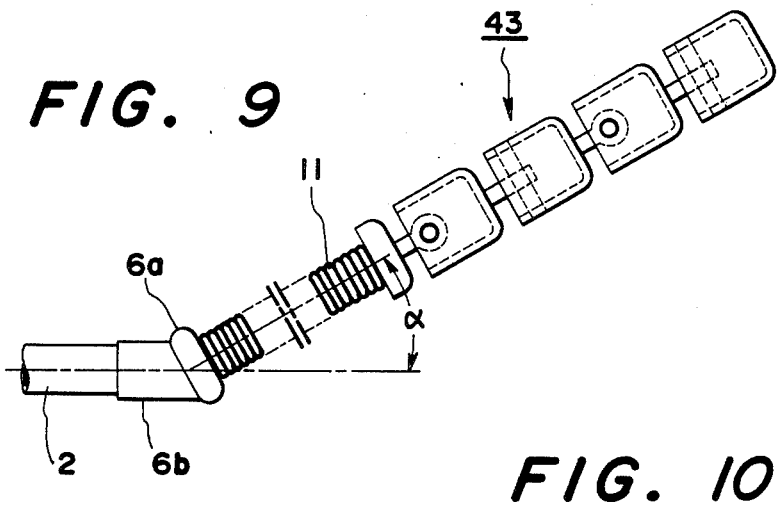
FIG. 9 is a side view showing another embodiment.
Figure 10:
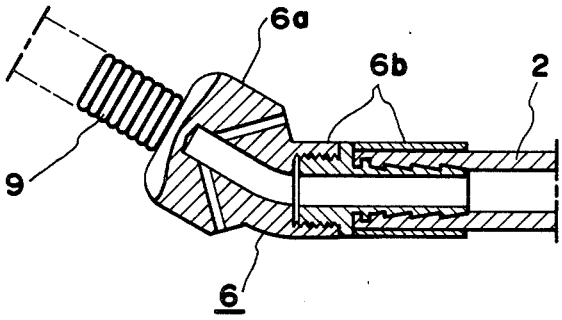
FIG. 10 is a cross section of the embodiment shown in FIG. 9.

As described in the foregoing, to rotate the nozzle spirally in the lateral pipe **46*a*, it becomes obvious that it can be achieved by changing the direction of the propulsion force of the nozzle 6 according to the rotation of the high-pressure hose 2. In this embodiment, as means for changing the direction of the propulsion force of the nozzle according to the rotation of the high-pressure hose, the construction of tilting the snake wire 11 for $\alpha$ degrees relative to the center axial line of the nozzle 6 is employed. If the foreging $\alpha$ degrees is the zero degrees like the head of the conventional high-pressure hose, namely, the snake wire 11 and the center axial line of the nozzle 6 are on a straight line, the direction of the nozzle 6, namely, the direction of the propulsion force by the high-pressure jet water is not changed even if the high-pressure hose is rotated so that the nozzle 6 is not revolved spirally in the lateral pipe 46*a*. As means for changing the direction of the propulsion force of the nozzle 6 according to the rotation of the high-pressure hose 2, other various means in addition to the foregoing means can be employed. For example, as shown in FIG. 6, the tip of the high-pressure hose 2 may be tilted by $\alpha$ degrees relative to the center axial line of the high-pressure hose 2 by a coil like bent spring 50. In FIG. 6, a bent pipe like metal fitting may be used for the bent spring 50. In the embodiment shown in FIG. 6, the snake wire is not fixed to the tip of the nozzle 6, and the universal guide 43 is directly connected to the projecting shaft 9 of the tip of the nozzle 6, but the snake wire may be disposed at a position on an extension of the center axial line of the nozzle 6 which is between the nozzle 6 and the universal guide 43. Also, as another embodiment, as shown in FIG. 7, a pipe like portion 6*b* of the nozzle 6 is bent for $\alpha$ degrees, and the tip 6*a* of the nozzle 6 is tilted relative to the tip of the high-pressure hose 2, or the snake wire may be provided in this embodiment. Also, as shown in FIG. 8, the tip portion 6*a* of the nozzle 6 may be tilted relative to the pipe like portion 6*b*, and the tip 6*a* of the nozzle 6 may be tilted relative to the tip of the high-pressure hose 2. As shown in FIG. 9 and FIG. 10, the snake wire 11 may project from the tip 6*b* of the nozzle 6 and be tilted relative to the pipe like portion 6*b* of the nozzle and the universal guide 43 may be connected to the snake wire 11**.

What is claimed is:

1. A rotary cleaning device for drain pipes and the like, wherein a nozzle having a center axial line is provided at the forward end of a high pressure hose having a center axial line, and a universal guide is connected to the forward end of the nozzle, and said nozzle has means for jetting high pressure water from the nozzle in a rearward direction at an angle to said center axial line of the nozzle to generate a propulsion force on the nozzle by the reaction force of the water, and said device has means for urging the high pressure hose into the inside of the pipe and simultaneously rotating the high pressure hose, whereby the inside of the pipe is cleaned by the high pressure water jetted from the nozzle, the improvement comprising means mounted on said nozzle for changing the direction of the propulsion force of the nozzle by the rotation of the high pressure hose for causing the nozzle to rotate in the pipe spirally along the inner peripheral surface of the pipe.

2. A rotary cleaning device according to claim 1 wherein the means for changing the direction of the propulsion force of the nozzle comprises a snake wire projecting from the forward end of the nozzle, and said universal guide connected to the free end of the snake wire, said snake wire being inclined at a predetermined angle to the center axial line of the nozzle.

3. A rotary cleaning device according to claim 1 wherein the means for changing the direction of the propulsion force of the nozzle comprises the forward end of the high pressure hose being inclined at a predetermined angle relative to the center axial line of the high pressure hose.

4. A rotary cleaning device according to claim 1 wherein the means for changing the direction of the propulsion force of the nozzle comprises the forward end of the nozzle being inclined relative to the forward end of the high pressure hose.

* * * * *